United States Patent [19]

Pause et al.

[11] 4,355,453

[45] Oct. 26, 1982

[54] METHOD OF PROTECTING THE SURFACES OF CONCRETE STRUCTURES

[75] Inventors: Hans Pause, Ratingen; Walter Stiller, Essen, both of Fed. Rep. of Germany

[73] Assignee: Philipp Holzmann Aktiengesellschaft, Frankfurt am Main, Fed. Rep. of Germany

[21] Appl. No.: 206,893

[22] Filed: Nov. 14, 1980

[30] Foreign Application Priority Data

Nov. 30, 1979 [DE] Fed. Rep. of Germany ..... 2948255

[51] Int. Cl.[3] ..... B23P 3/00; B23P 19/04

[52] U.S. Cl. ..... 29/460; 52/378; 52/746; 249/20; 264/33; 264/261; 425/63

[58] Field of Search ..... 29/460; 264/33, 261; 249/20; 425/63, 65; 52/169.14, 378, 446, 746, 413, 599, 598, 336

[56] References Cited

U.S. PATENT DOCUMENTS

| | | | |
|---|---|---|---|
| 1,242,039 | 10/1917 | Ratner | 52/413 |
| 1,915,896 | 6/1933 | Maul | 52/446 X |
| 1,956,354 | 4/1934 | Junkers | 52/378 X |
| 2,273,699 | 2/1942 | Fenton | 52/746 X |
| 2,496,616 | 2/1950 | Barton | 264/33 |
| 2,764,516 | 9/1956 | Pace | 264/261 X |
| 3,497,579 | 2/1970 | Barron | 249/20 X |
| 3,654,018 | 4/1972 | Bogue et al. | 264/261 X |
| 3,754,066 | 8/1973 | Black | 249/20 X |
| 3,793,795 | 2/1974 | Annand | 52/169.14 X |
| 4,128,610 | 12/1978 | Ahlgren | 249/20 X |

FOREIGN PATENT DOCUMENTS

| | | | |
|---|---|---|---|
| 184709 | 2/1956 | Austria | 264/33 |
| 1213564 | 4/1960 | France | 52/378 |

*Primary Examiner*—Charlie T. Moon

*Attorney, Agent, or Firm*—Auslander, Thomas & Morrison

[57] ABSTRACT

A method of constructing a poured concrete structure protected from corrosive agents includes applying large-surface sealing elements to one surface of the structure before pouring the concrete. The sealing elements are attached to anchoring elements extending into a region into which concrete is to be poured. When the concrete is poured inside the sealing elements, the sealing elements are anchored in place by the anchoring elements which become set in the concrete. The sealing elements may have a high modulus of elasticity and be relatively rigidly affixed to the structure of may have a low modulus of elasticity and thus require overlapping perimeter areas for sealing of adjacent sealing elements.

10 Claims, 7 Drawing Figures

METHOD OF PROTECTING THE SURFACES OF CONCRETE STRUCTURES

BACKGROUND OF THE INVENTION

The present invention relates to a method of protecting the surfaces of concrete structures erected with the use of sliding or climbing formwork from liquid and/or gaseous corrosive agents. Furthermore, the invention relates to a sealing element for the carrying out of this method.

Structural parts of cement-bonded and/or plastic-bonded concretes have only limited resistance to chemical attack (see J. Bicjok "Betonkorrosion, Betonschutz" (Concrete Corrosion, Concrete Protection), published by Bauverlag, Wiesbaden-Berlin, 1968). If the protective concrete layer of a structure of reinforced concrete is once damaged, steel corrosion which then commences can in the long run endanger the stability of the concrete structure. Corrosion of steel takes place when reagents penetrate into the concrete.

In the construction of industrial plants and other structures such as containers, bins, cooling towers, ventilation shafts, etc. it is therefore becoming increasingly necessary to protect the surface of the concrete from corrosive influences. Such protection requires additional operations, which means a delay in the course of the construction.

It is already known to protect the surfaces of the concrete by paints and/or groutings which are firmly bonded to the surface of the structural concrete. Such coatings or layers are, however, disadvantageous in various respects. When using climbing or sliding forms they cannot be applied in a reliable and satisfactory manner to the green concrete and they require increased protection against the influence of the weather. Furthermore, coatings applied directly on the concrete are not resistant to the action of vapor pressure from the inside. Rather, after only a short time they show damage due to formation of cracks as a result of internal vapor pressure, aging (ultraviolet rays) and the influence of weather from the outside. Impregnations applied to the green cement are also not sufficiently permanent.

Sheets or plates of plastic, rubber or metal applied in addition to the concrete structure can, to be sure, afford good protection but they generally require an additional operation which must be carried out at difficultly accessible places particularly when the structure is being produced by means of climbing forms and which therefore is inconvenient, time-consuming and expensive. Furthermore the bonding of the sheets or plates to the concrete to be protected is frequently problematical.

OBJECTS AND SUMMARY OF THE INVENTION

The object of the present invention is to effectively and permanently protect concrete structures in simple fashion at reasonable expense from liquid and/or vapor corrosive agents.

In accordance with the present invention, the large-area sheets, rubber webs, steel plates, etc. intended for the sealing are inserted into a climbing or sliding form upon the climbing or sliding and anchored to the concrete upon the pouring in thereof on the spot. The sealing is therefore effected in the same operation as the pouring of the concrete. In this connection the individual sealing elements may simultaneously serve as spacing means for the reinforcements of the concrete.

The sealing can be both continuous, in which connection vapor-pressure relief is provided for towards the outside or inside, or be obtained by means of folds, scale-like overlapping, etc. at the edges of the individual sealing elements. In the region of climbing rails, if the sealing elements are of low modulus of elasticity, strips of corrosion-resistant pressure-resistant material are provided in order to take up the loads exerted by the formwork, which strips are inserted into the formwork in the same operation as the other sealing elements. The sealing elements and these strips can in this connection be held by clamps or the like to form until the concrete which is thereupon poured in place has set sufficiently and the form can be brought to the next operating position. For the permanent attachment of the sealing elements in the concrete the elements are provided on their rear with ribs, props, pins or other anchoring elements which are embedded in the concrete of the structure and advisedly have such a shape that they engage in form-locked manner in the concrete.

The most different advantages are obtained as a result of the invention. Thus for instance one obtains gapless protection or gapless surface-sealing by means of a non-continuous coating or covering so that vapor-pressure relief is possible without damage to the protective layer. The sealing elements which are held in form-locked manner on the cement can deform independently of the structural concrete since they are attached to the concrete only at individual points, so that under the action of the weather and despite different shrinkage and expansion behavior than that of the concrete they are not torn or otherwise damaged by the concrete. Since the sealing elements are applied to the structure in the same operation as the pouring of the concrete, the "climbing" is not delayed by subsequent sealing. Furthermore no damage to the seal need be feared in the region of the climbing rails used for the climbing form. Since by the sealing of the concrete in accordance with the invention corrosive influences can be effectively screened off, the concrete covering of the reinforcements can be reduced to a minimum.

BRIEF DESCRIPTION OF THE DRAWINGS

By way of further explanation the invention will be further described below with reference to the drawing in which.

DETAILED DESCRIPTION OF THE PREFERRED EMBODIMENT

Figure 1:
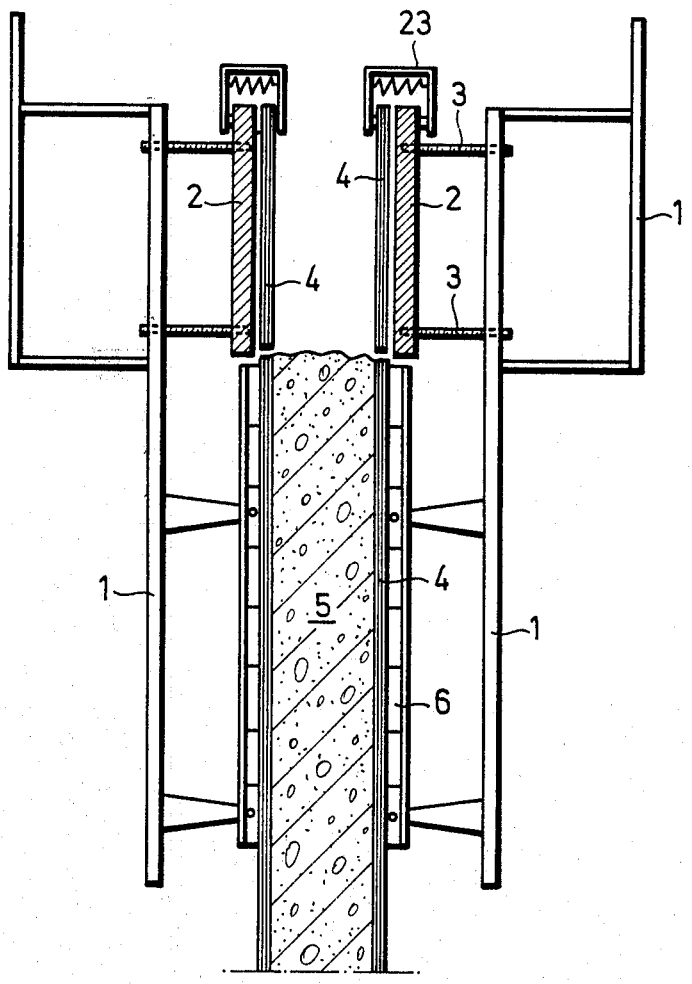
FIG. 1 is a vertical section through a structure progressively erected by means of a climbing form, having surfaces protected against corrosive agents.

FIG. 1 diagrammatically shows a climbing scaffolding 1 with hinged shuttering surfaces 2 which may be coated with Teflon on the inside of which plate-shaped, sheet-shaped or web-shaped sealing elements 4 are laid before the concrete 5 is poured. Spindles 3 are provided in order to adjust the shuttering surfaces 2. The sealing elements 4 are held by clamps 23 against the shuttering surfaces 2 until, after the pouring of the concrete, they are permanently anchored to the structural concrete. The climbing scaffold 1 is supported by means of climbing rails 6 which are arranged in the region of the part 5 of the structure which has already been concreted, against the surfaces thereof.

Figure 2:
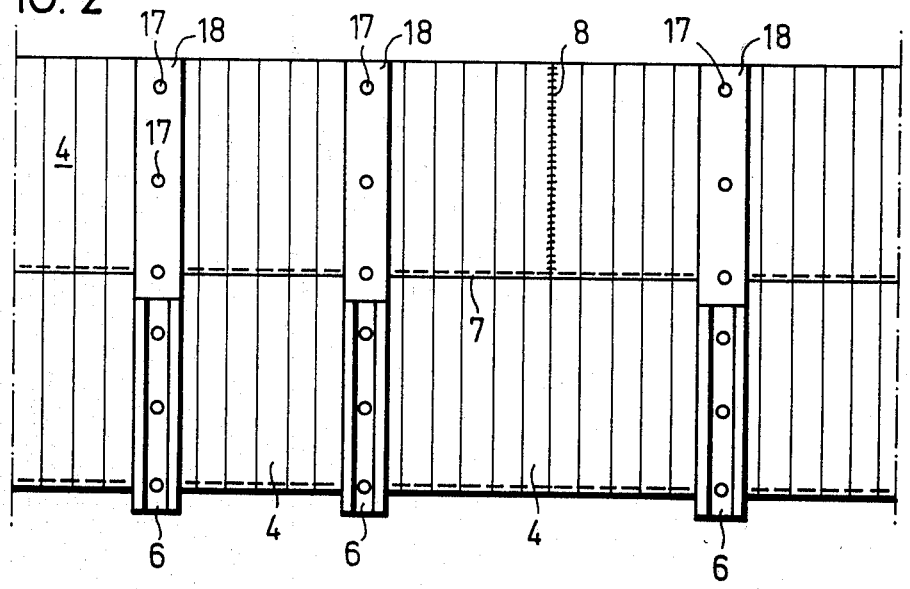
FIG. 2 is a partial view of a finished protected surface.

FIG. 2 shows the surface of a completely sealed concreting section with special insulation in the region of the climbing rails 6. In this case strips 18 of strong corrosion-resistant material are placed on the sealing elements 4 should the latter not have sufficient strength of their own. The individual sealing elements 4 are provided on their rear with anchoring elements 11 (FIG. 3) in the form of parallel webs and they are connected together at their edges by an overlap joint 7 or a welded joint 8.

Boreholes 17 serve to receive fastening elements for the climbing rails 6.

Figure 3:
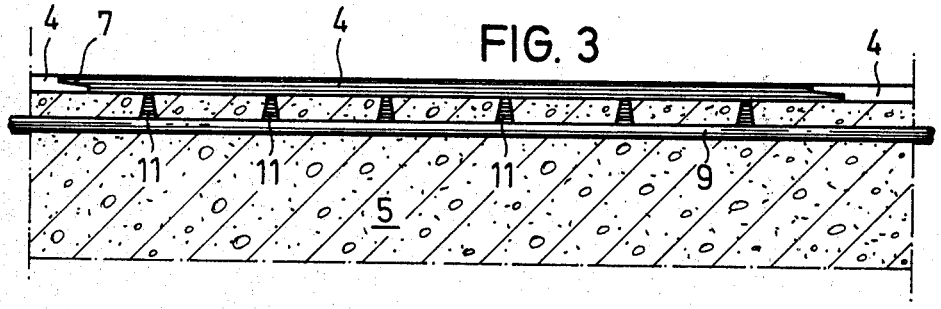
FIG. 3 is a section through a surface of a concrete structure which is protected by means of sealing elements of low modulus of elasticity.

FIG. 3 shows sealing elements 4 with obliquely stepped-down side edges which permit an overlap joint 7 with adjacent identical sealing elements 4. Anchoring elements 11 located on the rear of the sealing elements 4 lie within the completely concreted structure 5 and serve at the same time as spacers for an interior reinforcement 9. Thus the distance from the surface of the structure which is necessary for the covering of the reinforcement 9 can be assured precisely. Openings for the formwork spacers are put in place on the spot before the introduction of the sealing elements.

The anchoring elements 11 are preferable continuous webs or ribs but may also be props, bolts or pins. They have a widened head and thus engage in form-locked manner into the concrete of the structure 5.

Figure 4:
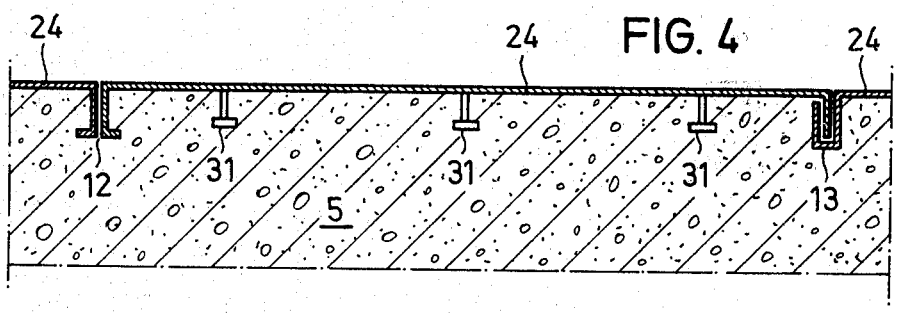
FIG. 4 is a section through the surface of a concrete structure which is protected by sealing elements of high modulus of elasticity.

While the sealing elements 4 shown in FIG. 3 may have a relatively low modulus of elasticity, FIG. 4 shows an embodiment in which the sealing elements 24 consist of a material of high modulus of elasticity. Accordingly the individual sealing elements 24 can be connected with each other by overlap joints 12 or folded seams 13. The sealing elements 24 are in this case anchored by anchoring elements 31 in the form of props, headed bolts, dowels or the like to the concrete structure 5.

Figure 5:
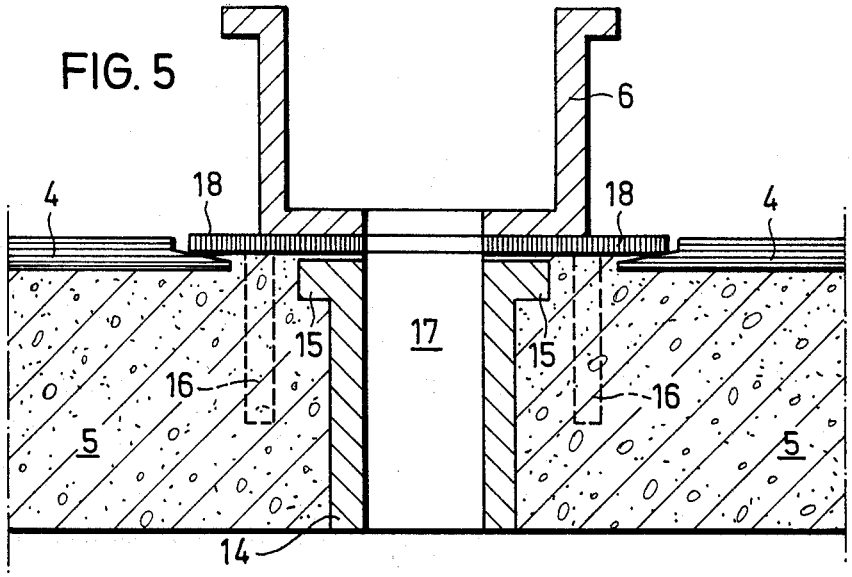
FIG. 5 is a horizontal section as in FIGS. 3 and 4, through the surface of the concrete structure in the region of a climbing rail which has been temporarily applied to it.

FIG. 5 shows the construction of the seal in the region of a climbing rail 6 in the event that the sealing elements 4 consist of material of low modulus of elasticity. The sealing elements 4 are grasped by a strip 18 of corrosion resistant material which is attached via dowels or props 16 to the structural concrete of the structure 5. In the region of the climbing rails 6, boreholes 17 are provided which serve to hold the climbing rails 6 required for the climbing system. A spacer 14 which may have a collar 15 serves for guiding anchoring bolts (not shown) adapted to be inserted in detachable manner through the boreholes 17, for the climbing rails 6.

Figure 6:
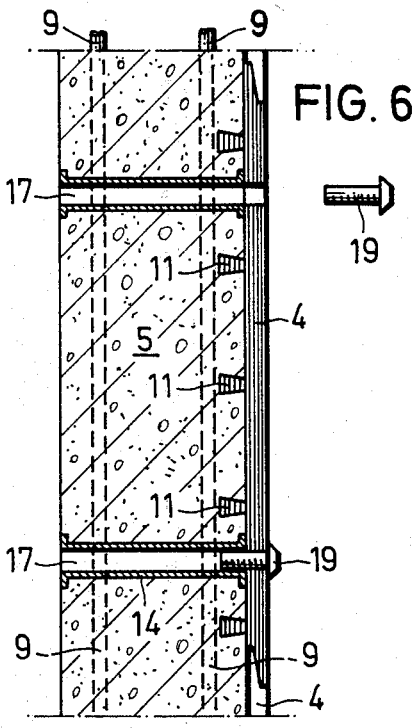
FIG. 6 is a vertical section through the concrete structure in which the surface lying to the outside is protected by web-shaped sealing elements which overlap in scale-like manner at their edges.

FIG. 6 shows how openings present in the sealing system are to be sealed off. For this purpose sealing plugs 19 are provided which fit into the spacer sleeves 14 and by means of their head grip over the sealing elements 4 in the weakened region. Again the reinforcement 9 contained in the structure 5 is held at the required distance from the outside of the concrete structure by web-shaped anchoring elements 11 of the sealing elements 4.

Figure 7:
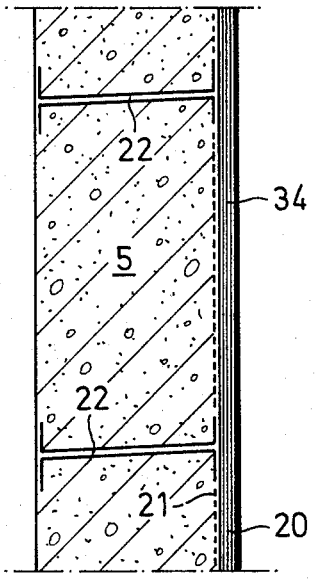
FIG. 7 is a vertical section through the concrete structure whose outer surface is protected by a seal formed of individual webs which are welded together.

FIG. 7 shows one possibility for vapor-pressure relief in the case that the seal of the concrete structure 5 consists of web-shaped sealing elements 34 which are welded together. Below the sealing elements 34 there is a vapor pressure relief layer 21 from which thin tubes 22 extend through the concrete structure 5 to the unendangered surface of the concrete structure or its rear side and through which the vapor pressure can be relieved so that it does not tend to lift the sealing elements 34 off from the concrete structure 5.

We claim:

1. A method of constructing a poured concrete structure protected from corrosive agents comprising the steps of:
   - applying large surface sealing elements supported by a formwork and defining at least one surface having a component in an upright direction of said concrete structure before pouring said concrete;
   - overlapping perimeter areas of adjacent sealing elements to provide protection to the concrete from liquids flowing under gravity forces;
   - providing anchoring elements on said sealing elements extending into a region into which concrete for said structure is to be poured;
   - attaching climbing rails for a climbing formwork to said anchoring elements;
   - applying a sealing strip having a high modulus of elasticity and great resistance to corrosion in a region of said climbing rails;
   - pouring said concrete inside said sealing elements and said formwork; and
   - setting said concrete whereby said sealing elements become anchored to said structure by said anchoring elements in set concrete whereby said climbing formwork is movable on said rails to another higher position.

2. A method according to claim 1, wherein said sealing elements are generally planar elements having low modulus of elasticity.

3. A method according to claim 1, wherein said anchoring elements are parallel webs.

4. A method according to claim 1, wherein said anchoring elements are pin-type device.

5. A method according to claim 1, wherein said anchoring elements include a widened end.

6. A method according to claim 1, wherein said sealing elements have high modulus of elasticity.

7. A method according to claim 1, further comprising folding said sealing elements to form folds which become anchored in said concrete.

8. A method according to claim 1, wherein the step of applying employs a sliding apparatus and includes coating a wall of said sliding apparatus with Teflon.

9. A method according to claim 1, wherein the step of applying includes sealing adjacent sealing elements with a diffusion resistant seal and relieving vapor pressure from a vicinity of said at least one surface toward a second surface of said structure.

10. A method according to claim 1, further comprising stepping adjacent edges of said sealing elements and overlapping the stepped edges.

* * * * *